United States Patent [19]

Yoshida et al.

[11] Patent Number: 4,640,996

[45] Date of Patent: Feb. 3, 1987

[54] IGNITION DISTRIBUTOR FOR INTERNAL COMBUSTION ENGINES

[75] Inventors: Ichirou Yoshida, Kariya; Morihiro Atsumi, Okazaki; Naotaka Nakamura, Chita; Kenji Yagi, Nagoya; Shunzo Yamaguchi, Okazaki; Manabu Yamada, Kariya, all of Japan

[73] Assignee: Nippondenso Co., Ltd., Kariya, Japan

[21] Appl. No.: 744,733

[22] Filed: Jun. 14, 1985

[30] Foreign Application Priority Data

Jun. 26, 1984 [JP] Japan ..... 59-131544
Mar. 19, 1985 [JP] Japan ..... 60-55240

[51] Int. Cl.[4] ..... H01H 19/00
[52] U.S. Cl. ..... 200/19 R; 200/19 DC; 200/19 DR
[58] Field of Search ..... 200/19 R, 19 DR, 19 DC, 200/262–270; 123/146.5 A, 633

[56] References Cited

U.S. PATENT DOCUMENTS 4,345,120 8/1982 Sawada ..... 200/19 DR X

FOREIGN PATENT DOCUMENTS 60-43179 3/1985 Japan .

*Primary Examiner*—J. R. Scott
*Attorney, Agent, or Firm*—Cushman, Darby & Cushman

[57] ABSTRACT

An ignition distributor for use in internal combustion engines has a noise preventive function capable of suppressing the generation of radiowave noises due to the spark discharge produced between a rotary electrode and stationary electrodes disposed on the side of the rotational circumference thereof opposing thereto. The ignition distributor has stationary electrodes and a rotary electrode, in which each of the plurality of stationary electrodes or rotary electrode has a main body made of a sintering product composed of powdery zinc oxide and powdery ferrite and a surface layer mainly composed of ferrite integrally formed to the surface portion of the main body.

6 Claims, 13 Drawing Figures

(A):CONVENTIONAL PRODUCT
(B):SECOND EMBODIMENT
(C):FERRITE

IGNITION DISTRIBUTOR FOR INTERNAL COMBUSTION ENGINES

BACKGROUND OF THE INVENTION

1. Field of the Invention

This invention concerns an ignition distributor of a type for making electrical connection through electrical sparkings and, more particularly, it relates to an ignition distributor having a noise preventing function of suppressing the generation of radiowave noises caused by spark discharges generated between a rotary electrode and stationary electrodes disposed on the side of the rotating circumference.

2. Brief Description of the Prior Art

Radiowave noises caused by spark discharges generated in an ignition system of an internal combustion engine mounted in automobiles or the likes give interferences to communication equipment such as television or radio receivers. The causes for generating the radiowave noises from the ignition system of the internal combustion engine mainly include the following three types, that is, (1) spark discharges between electrodes of an ignition plug, (2) spark discharges between the rotary electrode and the stationary electrodes of a distributor and (3) spark discharges due to the switching operation of the breaker points in the distributor.

Among the causes described above, while the following countermeasures (I)-(V) have been proposed as the means for preventing the radiowave noises caused by (2) above, they have drawbacks respectively and cannot attain a sufficient effect.

(I) Method of using a rotary electrode incorporated with resistive material,

This method uses a rotary electrode embedded with a resistor. However, since a distributed capacitance is present in parallel with the resistor, its noise suppressing effect is decreased at a high frequency wave region of about more than 300 MHz and also has a drawback that there is a large loss in the ignition energy due to the resistor (about several kiloohms). Furthermore, its noise suppressing effect is as low as about 5-6 dB even in the frequency region of lower than 200 MHz for which the noise suppressing effect can be expected.

(II) Method of using a rotary electrode applied with flame coating

This method uses a rotary electrode applied at the surface thereof with a high resistive material layer. However, this method has drawbacks, for example, in that (i) since a highly resistive material layer is formed to the surface of the electrode, the loss in the ignition energy is remarkable and (ii) the noise suppressing effect is as low as 5-6 dB in the frequency region lower than 200 MHz.

(III) Method of enlarging the discharging gap

In this method, the discharging gap between the rotary electrode and the stationary electrode is enlarged to about 1.5-6.4 mm. Although this method is advantageous in that it provides a noise suppressing effect as high as 15-20 dB, the loss in the ignition energy is extremely high because of the extremely large discharging gap, and gases corrosive to metals, such as nitrogen oxide ($NO_x$), are generated to corrode the rotary electrode since the discharging voltage between the electrodes becomes higher.

(IV) Method of using boride, silicide, carbide and electroconductive ceramics (specific resistivity from $10^{-6}$-$10^{-2}$ ohm cm) for the electrode While these substances show a low ignition energy loss because the resistance of the electrode is relatively low, the noise suppressing effect in the frequency region of lower than 300 MHz is as low as about 5-10 dB, as well as the electrode is liable to be consumed due to the local discharge since these substances are poor in the heat conduction.

(V) Method of using electroconductive ferrite for the electrode

This method can provide a satisfactory noise preventing effect as high as 10-15 dB. However, since the substance has a relatively small specific resistivity at low frequency, large current flows to cause heat generation by the induction discharge through the discharging gap. Further, since the substance has a poor heat conductivity, the electrode is locally consumed upon heat generation caused by discharge. On the other hand, in the case of using a ferrite having high specific resistivity, although the noise preventing effect and the durability are satisfactory, the loss in the ignition energy is higher.

SUMMARY OF THE INVENTION

The object of this invention is to overcome the foregoing problems in the prior art and provide an ignition distributor by the use of inexpensive electrodes having a sufficient noise suppressing effect, with less ignition energy loss and the top end of which is not consumed, cause eventual deterioration.

The ignition distributor for internal combustion engines according to this invention comprises: stationary electrodes connected to a plurality of ignition plugs of an internal combustion engine respectively; and a rotary electrode rotated interlocking with the crank shaft of the internal combustion engine and opposing to each of the stationary electrodes so as to form a minute gap successively upon rotation, wherein each of the plurality of stationary electrodes or rotary electrode comprises a main body made of a sintered product composed of powdery zinc oxide (ZnO) and powdery ferrite and a surface layer mainly composed of ferrite integrally formed to the surface of the main body.

BRIEF DESCRIPTION OF THE DRAWINGS

The exact nature of this invention, as well as other objects and advantages thereof, will be readily apparent from consideration of the following specification relating to the annexed drawings in which.

DETAILED DESCRIPTION OF THE INVENTION

Figure 1:
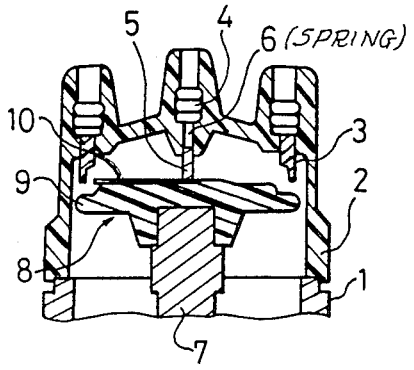
FIG. 1 is a cross sectional view showing a concrete structure of the ignition distributor according to this invention.

FIG. 1 is a cross sectional view showing a constitutional embodiment of an ignition distributor according to this invention. The distributor comprises a housing 1, a distributor cap 2 made of insulating material attached to the housing 1. Along the circumference at the upper bottom of the distributor cap 2, are protruded stationary electrodes 3. Each of the stationary electrodes 3 is connected by way of a high voltage cable not illustrated to each of ignition plugs. Further, at the center of the upper bottom of the distributor cap 2, is mounted a protruding central terminal 4. The central terminal 4 is connected to a secondary coil of an ignition coil not illustrated. The top end of the central terminal 4 is disposed with an electroconductive spring 6, and the spring 6 is disposed with a slider 5 made of a carbon body slidably supported to the distributor cap 2. While on the other hand, a cam shaft 7 is disposed in the inner space defined with the housing 1 and the distributor cap 2. The cam shaft 7 rotates interlocking with the crank shaft of an internal combustion engine. A distributor rotor 8 is disposed to the upper end of the cam shaft 7. The distributor rotor 8 comprises an insulation substrate 9 and a rotary electrode 10 disposed on the upper surface of the insulation substrate 9. The rotary electrode 10 is in contact at one end thereof to the slider 5 by the resilient force of the electroconductive spring 6. Further, the rotary electrode 10 is rotated accompanying the rotation of the distributor rotor 8 such that it situates to a position opposing to the plurality of stationary electrodes 3 successively with a minute gap.

When the rotary electrode 10 comes to a position opposing to one of the plurality of stationary electrodes 3 with a minute gap as shown in FIG. 1, since a high voltage generated from the ignition coil is applied to the central terminal 4, spark discharge is resulted in the minute gap due to the insulation destruction of air and, simultaneously, discharge is also resulted through the spark gap in the ignition plug disposed in series with the minute gap, whereby desired ignition operation is conducted. In this case, discharge is also conducted through the minute gap between both of the electrodes 3 and 10 of the distributor along with the spark discharge in the ignition plug, which causes the generation of noises.

In the above-described operation, the high voltage supplied from the ignition coil does not reach the maximum value stepwise. Specifically, the voltage applied across the discharge gap of the distributor rises with a time constant determined by the circuit constant of the ignition coil, high voltage cable and the like. Then, when the voltage rises to a sufficient level to produce spark discharge in the discharge gap, insultion destruction is resulted through the air in the discharge gap to generate spark discharge. Because of the generation of the abrupt insulation destruction, the discharge current with a short pulse width (from several tens to hundred amperes) flows rapidly. Furthermore, since this is an instable current with a high peak value, a great amount of deleterious high frequency components are generated, which are radiated through the high voltage cable or the like as an antenna externally to form radiowave noises.

Since the radiowave noises emitted from the noise source are in proportion with the noise current, it is required to reduce the noise current in order to suppress the radiowave noises.

By the way, the discharge current flowing between the rotary electrode and the stationary electrode includes two types, that is, a capacitive discharge current and an inductive discharge current.

Referring at first to the capacity discharge current, it is a high frequency current resulted from electrical charges accumulated in the capacitance between the rotary electrode and the stationary electrode, stray capacitance between the high voltage cable and the ground, between the electrodes and the ground near the discharge gap and the like, which flow with a rapid rising instantaneously upon insulation destruction between the gaps (several nanosecond) and this forms the noise current.

While on the other hand, the inductive discharge current is a low frequency current (from several tens to hundred mA) and the ignition energy supplied to the ignition plug is approximately in proportion with the product of the induction discharge current I and discharge continuation period T.

Accordingly, it can be seen that only the capacitive discharge current needs to be reduced in order to suppress the noise current without reducing the ignition energy.

Figure 2:
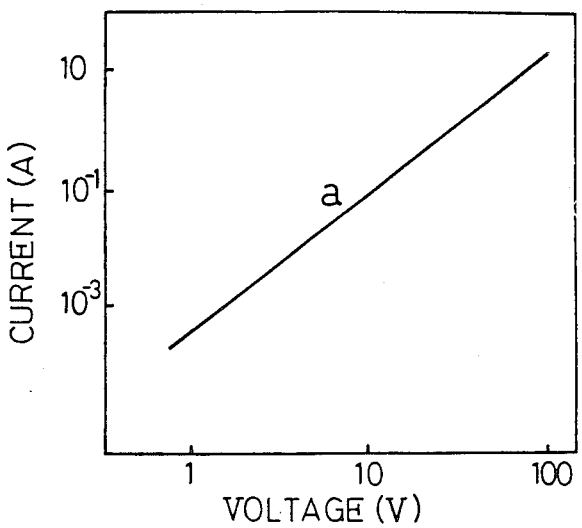
FIG. 2 is a current/voltage characteristic chart for the electroconductive ceramics employed in the conventional electrode of the ignition distributor.

In view of the above, while it has been proposed to use ceramic dielectric materials for the method of suppressing the noise current as in methods (IV) and (V) described above, their resistance is reduced in order to decrease the ignition energy loss. Therefore, an excess current flows to the electrode to generate heat even under a low voltage as shown by the linear curve (a) in FIG. 2. Further in this case the electrodes are liable to be consumed due to the local discharge since these substances are poor in the heat conduction.

According to this invention, each of the plurality of stationary electrodes or rotary electrode comprises a main body made of a sintering product composed of powdery zinc oxide (ZnO) and powdery ferrite and a surface layer mainly made of ferrite as a main ingredient integrally formed to the surface of the main body.

In this invention, the electrode may be constituted by integrally sintering the surface layer mainly composed of ferrite to the discharging surface of the main body made of the sintering product composed of from 80 to 95 mol % of powdery ZnO and from 5 to 20 mol % powdery ferrite.

Figure 4:
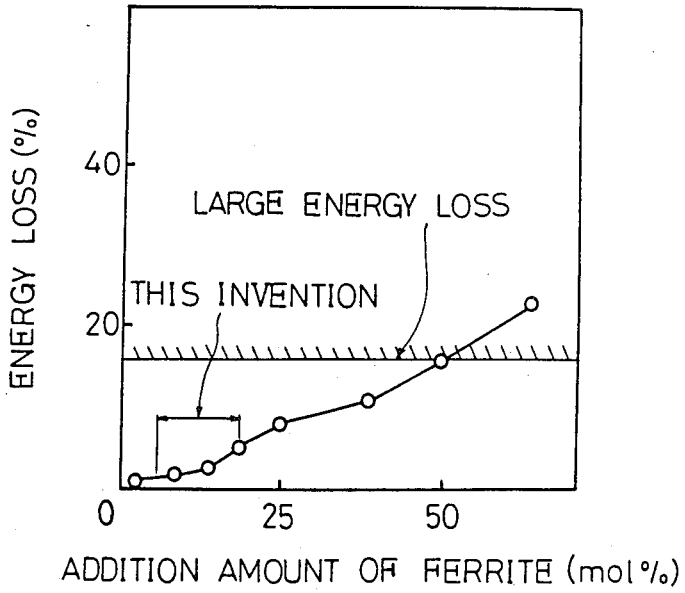
FIG. 4 is a graph showing the characteristic of the energy loss in the electrode which was prepared while varying the mixing amount of ferrite to zinc oxide in the first embodiment.

As a method of preparing the surface layer in this invention, the material comprising zinc oxide (ZnO) incorporated with ferrite is sintered in an atmosphere containing oxygen to form the surface layer mainly composed of ferrite only at the surface. Accordingly, consumption of the discharging surface due to discharge can be prevented at the ferrite surface layer and, further, since the inside is constituted with a composition having a high content of ZnO, which is a semiconductor, and has a low specific resistivity, the loss in the ignition energy can be reduced extremely low as shown in FIG. 4.

Figure 11:
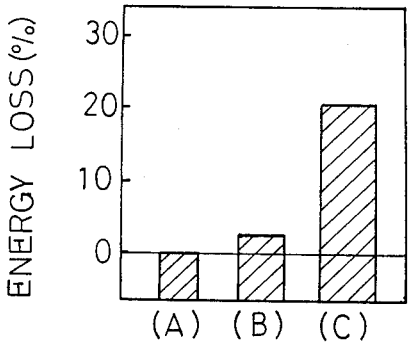
FIG. 11 is a graph showing the energy loss in the electrode according to the second embodiment and the ferrite electrode in comparison with that in the conventional metal electrode.
Figure 12:
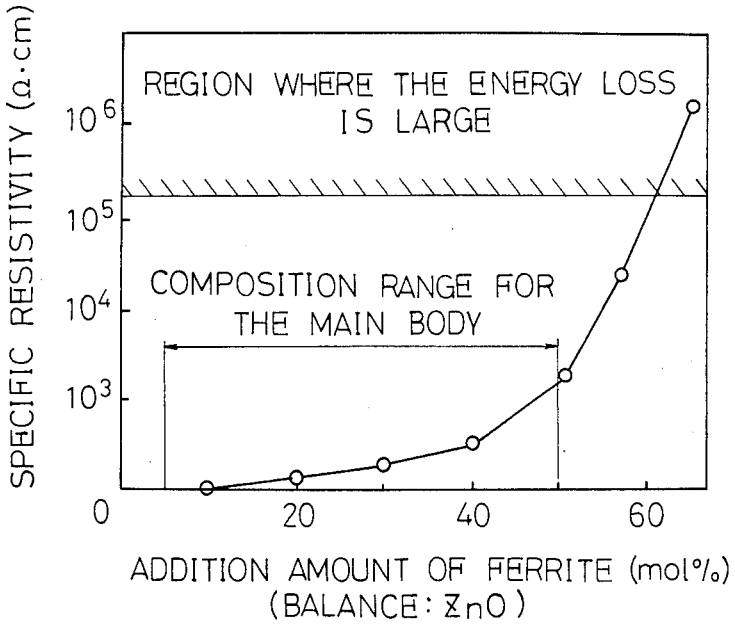
FIG. 12 is a graph showing the characteristics of the energy loss in the electrode which was prepared while varying the mixing amount of ferrite to zinc oxide in the second embodiment.

In this invention, the electrode may be constituted by integrally sintering the surface layer mainly composed of ferrite to the discharging surface of the main body made of the sintering product composed of from 50 to 95 mol % of powdery ZnO and from 5 to 50 mol % of powdery ferrite. Accordingly, consumption at the discharging surface due to discharge can be prevented with ferrite. Moreover, since the inside is constituted with a composition having a high content of ZnO, which is a semiconductor, and has a low specific resistivity, as shown in FIG. 11, the energy loss upon ignition can be reduced extremely low as compared with the case where the layer is composed only of ferrite. In the FIG. 11, the energy loss in the case of a metal electrode as a conventional product is represented as zero. As shown in FIG. 12, if the ferrite content in the main body is more than 50 mol % (the balance being ZnO), it can no more be used since the specific resistivity thereof enters the region where the energy loss is large. While, in a region where the ferrite content is less than 5 mol %, ferrite in the discharging portion diffuses remarkably into the main body, to thereby cause deformation or reduction in the strength due to the difference in the shrinkage between the main body and the discharging portion at the junction upon sintering and increase in the resistance of the junction. Therefore, the addition amount of ferrite to ZnO is suitably between 5–50 mol % and, optimally, 40 mol %. Further, a temperature of higher than 1,330° C. is desired as the sintering condition, because no sufficient junction can be attained between both of the portions at a temperature lower than the above specified level.

Figure 8:
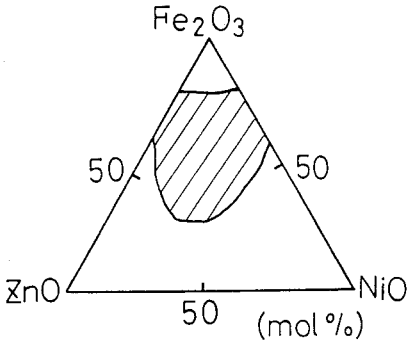
FIG. 8 is a desired composition diagram for the ferrite.

The powdery ferrite usable herein as one of the ingredients in the sintering product can include those ferrites such as Ni-Zn ferrite ((Ni-Zn) $Fe_2O_4$), Mn-Zn ferrite, as well as $NiFe_2O_4$, (Ni-Mn)$Fe_2O_4$. Other ferrites usable herein also include those represented by the general formula: $MFe_2O_4$ (where M represent Mg, Fe, Co, Ni, Cu, Li which is used singly or in combination), iron oxides of a magneto plumbite type crystal structure represented by the formula: $MFe_{12}O_{19}$ (where M represent Ba, Sr, Pb or the like), those of a perovskite type crystal structure represented by the formula: $MFeO_3$ (M represents rare earth element) and those of a garnet type crystal structure represented by the formula: $M_3Fe_5O_{12}$ (where M represents rare earth element). In the case of the using Ni-Zn ferrite, those of a composition ratio included within the hatched region shown by the composition diagram in FIG. 8 are desirably used. Zinc oxide ferrite ($ZnFe_2O_4$) is effective for enhancing the magnetic permeability.

By the addition of magnetic material such as Ni-Zn ferrite into ZnO, high frequency magnetic fields are generated due to the noise current and the noise current can be suppressed by eddy current loss or hysteresis loss due to the high frequency magnetic field. For a certain frequency, a magnetic material with higher magnetic permeability provides greater suppressing effect for the noise current due to greater eddy current loss. However, the loss in the inductive charge of the low frequency current is undesirably increased if the magnetic permeability is too high. Accordingly, there is a proper range for the permeability. For instance, a magnetic material with a specific magnetic permeability of 100 can absorb to suppress the noise current in a frequency range from 50 to 500 MHz within an allowable limit for the energy loss upon ignition.

Figure 3:
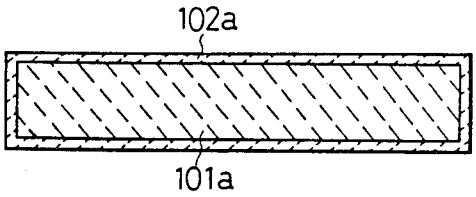
FIG. 3 is a schematic structural view for the electrode used in the ignition distributor according to a first embodiment.
Figure 10:
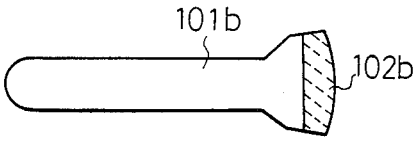
FIG. 10 is a plan view showing the rotary electrode in the distributor shown in FIG. 1 in a second embodiment.

The surface layer made of ferrite can be obtained by sintering in oxygen or air. Specifically, the electrode material may be sintered in a gaseous oxygen or the electrode material sintered in other atmosphere may be fabricated upon forming of the electrode and finally sintered in an oxygen-containing atmosphere. The electrode manufactured in this way comprises, for example, as shown in FIGS. 3 and 10, the surface layer (referred to as a ferrite layer) 102*a*, 102*b* the surface of which is mainly composed of ferrite and the main body 101*a*, 101*b* the inside of which is a composite layer made of a mixture of zinc oxide and ferrite.

If the powdery ferrite is contained not less than 20 mol %, energy loss upon ignition of not less than 10% is resulted. On the other hand, if the powdery ferrite is contained not more than 5 mol %, since no sufficient formation of the ferrite layer is obtained at the surface, the top end is violently consumed by the discharge over a long period of time. Accordingly, the powdery ferrite is desirably contained in the above-specified ratio.

The thickness of the surface layer made of ferrite is preferably in a range of 0.1–1 mm. When the surface layer is less than 0.1 mm in thickness, a high resistive layer made of ferrite constituting the top end will be consumed by the discharge and lose the protective function to the internal low resistive layer, thereby resulting in the violent consumption of the discharging surface of the main body. Conversely, when the surface layer is more than 1 mm in thickness, because the ferrite forming the surface layer is the high zinc ferrite having a high specific resistance, the substantial resistance of electrodes will be too high and the energy loss becomes extremely large.

It is considered, for the reason why the ferrite layer is formed at the surface during sintering in an oxygen atmosphere, that a small amount of ferrite functions as nuclei at the location where the oxygen is present and ZnO is readily solid-solubilized into ferrite. Further, the ferrite layer formed at the surface attains the improvement in the effect of suppressing the radiowave noises due to the addition of a slight amount of ferrite. Although most of the detailed mechanisms have not yet been clear at present, the current is concentrated more toward the surface due to the surface effect as the frequency goes higher and, since the surface is made of the ferrite layer, a high inductance is formed to the high frequency. In view of the above, it is considered that only the high frequency components can be suppressed effectively.

The present invention has the features and advantages summarized below.

In the distributor according to this invention, zinc oxide is utilized as an ingredient for the electrode thereof. Since the sintering product of zinc oxide has a low specific resistivity, if an electric current flows through the zinc oxide portion, the energy loss caused thereby is small. Further, since the magnetic material is added, high frequency components can be suppressed by utilizing the loss of eddy current and hysteresis loss. In addition, since the surface layer mainly composed of ferrite is formed at the surface in this invention, the inductance is higher in the surface portion to increase the inductance to the high frequency components thereby enabling to suppress the high frequency current.

Furthermore, since the ferrite at the discharging surface is integrally sintered with the electrode main body, the manufacturing procedure is facilitated requiring no joining step, no crackings occur in the ferrite upon joining, the length of the ferrite on the discharging surface can be set with ease. Moreover, since a sufficient amount of ferrite is remained at the discharging surface even if surface polishing is carried out to the ferrite at the discharging portion, the effect of suppressing the radiowave noises is not reduced.

DETAILED DESCRIPTION OF THE PREFERRED EMBODIMENTS

This invention will now be described referring to examples.

EXAMPLE 1

Figure 5:
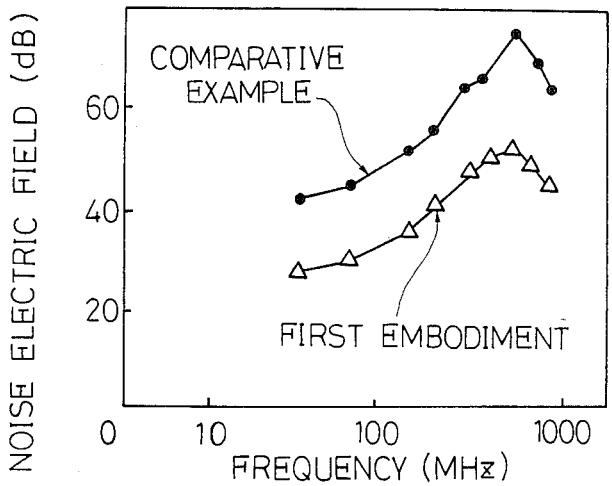
FIG. 5 is a chart for measurement showing the frequency characteristics of the noise electric field intensity for the ignition distributor according to the first embodiment of this invention, and conventional ignition distributor (rotor applied with flame coating)

After mixing and pulverizing in a wet manner 50 mol % of iron oxide ($Fe_2O_3$) with 35 mol % of nickel oxide (NiO) and 15 mol % of zinc oxide (ZnO) in a ball mill, they were sintered at 1,100° C. for 2 hours to synthesize Ni-Zn ferrite. The ferrite had a magnetic permeability of 1,000. A starting material comprising 15 mol % of the thus synthesized ferrite and 85 mol % of zinc oxide incorporated with about 1% by weight of polyvinyl alcohol (PVA) as a binder was press-molded in a dried manner into a rotary electrode configuration. The molding product was sintered in an air under the conditions of a temperature rising rate at 100° C. per hour, retention temperature at 1,400° C., retention time of 2 hours and temperature fall rate at 100° C. per hour. The specific resistivity of the rotary electrode prepared in this step was $2\times10^5$ ohm·cm and the specific permeability was about 30 under the condition of DC 100 V. The ignition distributor was operated while mounting the thus prepared rotary electrode to the ignition distributor and rotating the crank shaft at a rotating speed of 1,500 rpm, and the result of the measurement, with the frequency characteristics of the electric field intensity as 1 $\mu$V/m=0 dB at the frequency region of 120 KHz is shown in FIG. 5. As can be seen from the figure, the distributor according to this embodiment had a noise suppressing effect of more than 10 dB as compared with that of the conventional distributor having the rotary electrode applied with flame coating (comparative example). Furthermore, as compared with a distributor composed of an electroconductive ferrite which had a relative large effect in view of the noise suppression but involves a drawback in the durability, the distributor according to this embodiment had a higher durability and provided no problems after actual running of vehicle for 100,000 km.

Figure 9:
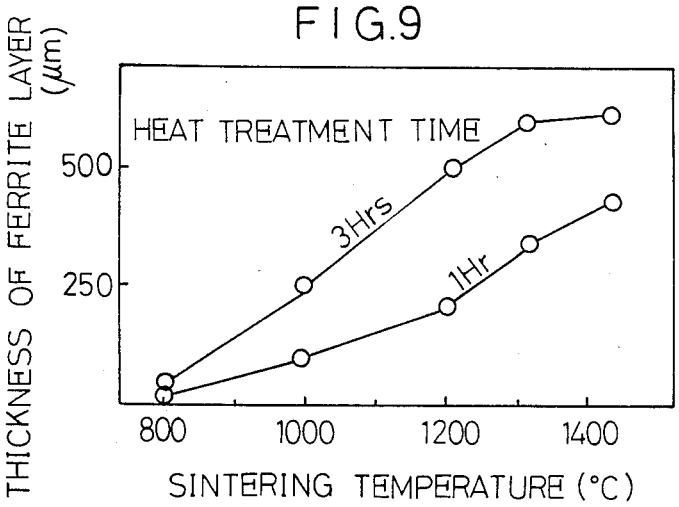
FIG. 9 is a graph showing the relationship between the sintering temperature and the thickness of the formed ferrite layer in the first embodiment.

The electrode according to this embodiment does not show its excellent performance if the surface is ground by means of a grinder machine or the like after the sintering, because the layer mainly composed of zinc oxide is exposed to the surface by the grinding work while the ferrite layer is removed. However, if such a processed electrode is subjected to heat treatment in an air (atmosphere containing oxygen) at a temperature higher than 600° C., the layer of the ferrite can be formed again at the surface. The thickness of the layer can be controlled depending on the conditions of the heat treatment. The results are shown in FIG. 9. It can be seen from the figure, that the thickness of the ferrite layer is increased as the temperature rises.

Figure 6:
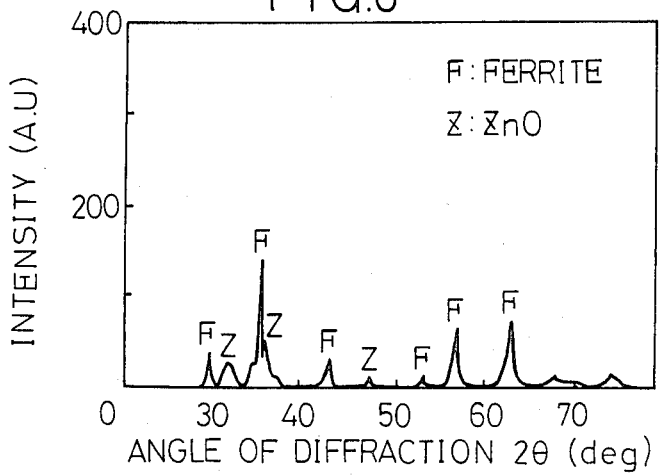
FIG. 6 is a chart for measurement showing the result of the X-ray diffractometry for the surface of the electrode jsut after the grinding work in the first embodiment.
Figure 7:
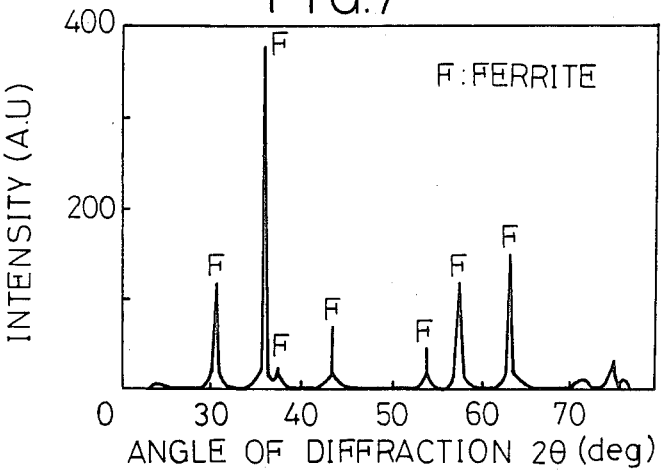
FIG. 7 is a chart for measurement showing the result of the X-ray diffractometry for the surface of the electrode after the heat treatment applied subsequently in the first embodiment.

FIG. 6 shows the result of the X-ray diffractometry for the surface of the electrode just after the grinding work and FIG. 7 shows the result of the X-ray diffractometry for the surface of the electrode after heat treatment at 800° C. for 10 min. From these results, it can be seen that the ferrite layer is formed again at the surface through sintering, because the peak of ZnO disappears and only the peak of ferrite can be seen due to the heat treatment.

EXAMPLE 2

After mixing and pulverizing in a wet manner 50 mol % of iron oxide ($Fe_2O_3$), 35 mol % of nickel oxide (NiO) and 15 mol % of zinc oxide (ZnO) in a ball mill, they were sintered at the 1,100° C. for 2 hours, to synthesize Ni-Zn ferrite. The ferrite had a magnetic permeability of 1,000. Starting material A was prepared by adding about 1% by weight of polyvinyl alcohol (PVA) as a binder to 40 mol % of the thus synthesized ferrite and 60 mol % of zinc oxide.

After mixing and pulverizing in a wet manner 50 mol % of iron oxide ($Fe_2O_3$) with 21 mol % nickel oxide (NiO) and 29 mol % of zinc oxide (ZnO) in a ball mill, they were sintered at the 1,100° C. for 2 hours, to synthesize Ni-Zn ferrite. The ferrite had a magnetic permeability of 1,500. Starting material B was prepared by adding about 1% by weight of polyvinyl alcohol (PVA) as a binder to the thus synthesized ferrite.

These starting materials A and B were weighted as: (starting material A=40 mol % ferrite+60 mol % ZnO):(starting material B=ferrite)=3:1 by weight ratio, and they were press-molded into a rotary electrode configuration in the dry manner as shown in FIG. 10 with the ferrite portion of the starting material B as the discharging surface and the remaining portion as the main body (in this case, ¼ of the entire portion constitutes the ferrite **102*b* in the state shown in FIG. 10**).

The molding product was sintered under the conditions of temperature rising rates at 100° C. per hour, retention temperature at 1,400° C., retention time of 2 hours and temperature falling rate at 100° C. per hour.

Figure 13:
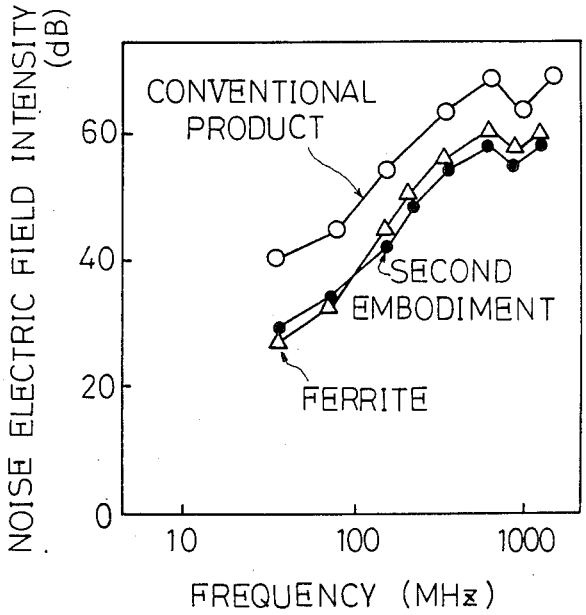
FIG. 13 is a chart for the measurement showing the frequency characteristics of the noise electric field intensity for the ignition distributor according to the second embodiment of this invention, and the conventional ignition distributor with a metal electrode.

The ignition distributor was operated while mounting the rotary electrode to the distributor and rotating the crank shaft at the rotating speed of 1,500 rpm and the result of measurement while setting at the frequency characteristics of the electric field intensity as 1 $\mu$V/m=0 dB the frequency band of 120 KHz is shown in FIG. 13. As can be seen from the figure, the distributor according to this embodiment can provide the effect of noise suppression of 15–20 dB, which is substantially at the same degree as the ferrite electrode, when compared with the conventional distributor using the metal electrode (conventional product).

As each of the ferrites for the starting materials A and B used herein, while those as described in the examples were approximately optimum, those represented as: $Ni_xZn_{1-x}Fe_2O_4$ (x=1-0.3) were usable as each of the ferrites for the starting materials A and B.

What is claimed is:

1. An ignition distributor for an internal combustion engine which has a plurality of ignition plugs and a crankshaft comprising:

a plurality of stationary electrodes, each connected to one of said ignition plugs respectively; and a rotary electrode coupled to said crank shaft of said internal combustion engine to rotate interlocked therewith, and located opposing each of said stationary electrodes so that a minute gap is formed between said rotary electrode and each of said stationary electrodes successively, upon rotation of said rotary electrode, wherein at least one of:(a) each of said plurality of stationary electrodes, and (b) said rotary electrode comprises a main body composed of zinc oxide and ferrite and a surface layer mainly composed of ferrite integrally formed on the surface of said main body.

2. The ignition distributor for internal combustion engines according to claim 1, wherein said surface layer is integrally formed on the entire surface of said main body, and the main body of said electrode is made of a sintered product of a powdery mixture composed of from 80 to 95 mol % of powdery zinc oxide (ZnO) and from 5 to 20 mol % of powdery ferrite.

3. The ignition distributor for internal combustion engines according to claim 1, wherein said surface layer is integrally formed on only a discharging surface of said main body, and the main body is made of a sintered product of a powdery mixture composed of from 80 to 95 mol % of powdery zinc oxide (ZnO) and from 5 to 20 mol % of powdery ferrite, and said surface layer is made of a sintered product composed essentially of ferrite.

4. The ignition distributor for internal combustion engines according to claim 1, wherein the ferrite as the ingredient for constituting the electrode is nickel-zinc (Ni-Zn) ferrite or manganese-zinc (Mn-Zn) ferrite.

5. The ignition distributor for internal combustion engines according to claim 2, wherein the surface layer is formed by sintering in an atmosphere at least containing gaseous oxygen.

6. The ignition distributor for internal combustion engines according to claim 1, wherein the thickness of said surface layer is in a range of 0.1-1 mm.

* * * * *